United States Patent [19]

Lauritano

[11] Patent Number: 4,704,779

[45] Date of Patent: Nov. 10, 1987

[54] TOOL FOR TORQUING ROTATABLE MEMBERS

[76] Inventor: Giuseppe Lauritano, 534 Laurel St., Redwood City, Calif. 94063

[21] Appl. No.: 904,504

[22] Filed: Sep. 8, 1986

[51] Int. Cl.[4] ..... B25B 13/06

[52] U.S. Cl. ..... 29/240

[58] Field of Search ..... 81/13, 55, 57.32, 57.36; 29/240, 237

[56] References Cited

U.S. PATENT DOCUMENTS

| | | | |
|---|---|---|---|
| 2,367,689 | 1/1945 | Providence | 81/13 |
| 2,599,489 | 6/1952 | Schmidt | 81/55 |
| 2,600,214 | 6/1952 | Davis | 81/13 |
| 3,935,760 | 2/1976 | Taylor | 81/55 |

*Primary Examiner*—Robert C. Watson
*Attorney, Agent, or Firm*—Bielen & Peterson

[57] ABSTRACT

A tool for separating or assembling first and second relatively rotatable members. Such members are stopped from such rotation by a shear pin after assembly and require breaking of the shear pin for separation. The tool utilizes first and second portions capable of engaging the first and second members respectively. The first and second members are rotatable about an axis relative to one another in a sufficient degree to permit the insertion of the shear pin or to break the shear pin. The first portion and second portion of the tool are held in axial alignment during rotation of the first and second portions of the tool relative to one another.

5 Claims, 3 Drawing Figures

TOOL FOR TORQUING ROTATABLE MEMBERS

BACKGROUND OF THE INVENTION

The present invention relates to a novel tool for separating and assembling first and second members rotatable in relation to one another, in conjunction with a shear pin.

Bushings are often threaded into one another and held in this tightened condition by shear pin to prevent loosening by reversal of such threading. This construction is very common in aircraft landing gear and in other aircraft parts. Damaged aircraft landing gear often requires removal of these threaded bushings and, necessarily, the breaking of the shear pin holding them together. The shear pin is inserted when the threaded bushings ae initially torqued. The breaking of the shear pin is very difficult job requiring a much greater torque than the initial torque required to thread one bushing into another.

In the past, the shear pin has been broken by fixing one of the bushings with a wedge, commonly in the shape of a cone, and jamming the wedge in place with a screwdriver. The remaining threaded bushing not wedged into place is then turned to break the shear pin. Assembly of these bushing entail a similar procedure. This prior method often damages the bushings and requires an enormous amount of time and labor to perform.

A tool which simplifies the separation and assembly of a pair of bushings held together by shear pin would be a great advance in the field of aircraft maintenance.

SUMMARY OF THE INVENTION

In accordance with the present invention a novel and useful tool for separating and assemblying first and second members rotatable in relation to one another in conjunction with a shear pin is provided.

The tool of the present invention may be employed for separating a first member rotatable in relation to a second member. The first and second member rotation is prevented by a shear pin. The tool of the present invention may be used with a moment or torque arm tool such as a ratchet or socket wrench.

The tool includes a first portion capable of engaging the first member for movement with that member about an axis. A second portion of the tool is capable of engaging the second member for movement therewith about the same axis as the first member. The first and second portions of the tool of the present invention may include protrusions or recesses to engage the exterior surfaces of the first and second members.

The tool of the present application may also be deemed to have means for rotating the first portion relative to the second portion a sufficient degree to shear the break pin. Such means of rotating the first and second members relative to one another may take the form of providing a socket in the first portion and/or second portion which is engageable by the torque arm tool. Such a provision would permit manual breaking of the shear pin in most cases and also permit access to the first and second members when positioned in a hard-to-reach area.

In addition, means is provided for holding the first portion of the tool in axial alignment with the second portion of the tool relative to the axis of the first and second portions. Such holding means would act in this capacity during rotation of the first and second portions relative to one another. The holding means may take the form of a threaded opening through the first portion and a threaded opening in the second portion. The threaded opening in the second portion may also pass through the second portion in certain embodiments. A threaded member such as a bolt may threadingly engage the threaded openings in the first and second members. Thus, relative rotation of the first and second members would not be hindered by the structure of the threaded bolt. The above described socket may be constructed to lie co-axially with the bolt.

Further, the tool of the present invention may be employed to assemble first and second members which threadingly engage one another and are held against further rotation, after assembly, by a shear pin.

It may be apparent that a novel and useful tool for separating first and second members held against rotation by a shear pin has been described.

It is therefore an object of the present invention to provide a tool for separating first and second members held against rotation by a shear pin which permits the manual use of the torque tool to shear the pin with facility.

It is another object of the present invention to provide a tool for separating first and second members held against the rotation by a shear pin which permits access to the members when such member are not reachable by tools of the prior art.

Yet another object of the present invention is to provide a tool for separating first and second members held against rotation by a shear pin which greatly reduces the labor involved in separating the first and second members normally expended by use of tool of the prior art.

A further object of the present invention is to provide a tool for separating first and second members held against rotation by a shear pin which cleanly separates such members and, thus, increases the safety factor in the field of aviation.

Another object of the present invention is to provide a tool for applying torque to assembly first and second members rotatable relative to each other and held in an engaged position under such torque by a shear pin.

The invention possesses other objects and advantages especially as concerns particular characteristics and features thereof which will become apparent as the specification continues.

For a better understanding of the invention reference is made to the following detailed description of the preferred embodiments thereof which should be referenced to the hereinabove drawings.

DESCRIPTION OF THE PREFERRED EMBODIMENTS

Various aspects of the present invention will evolve from the following detailed description of the preferred embodiments thereof which should be taken in conjunction with the hereinabove described drawings.

Figure 2:
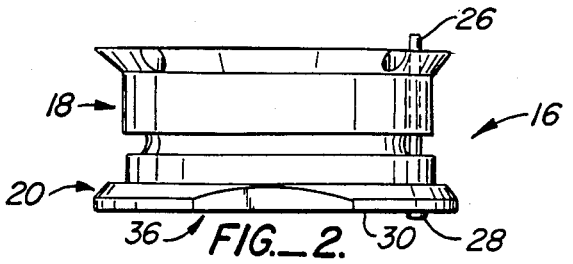
FIG. 2 is a side elevational view of the first and second members held against rotation by a shear pin.
Figure 3:
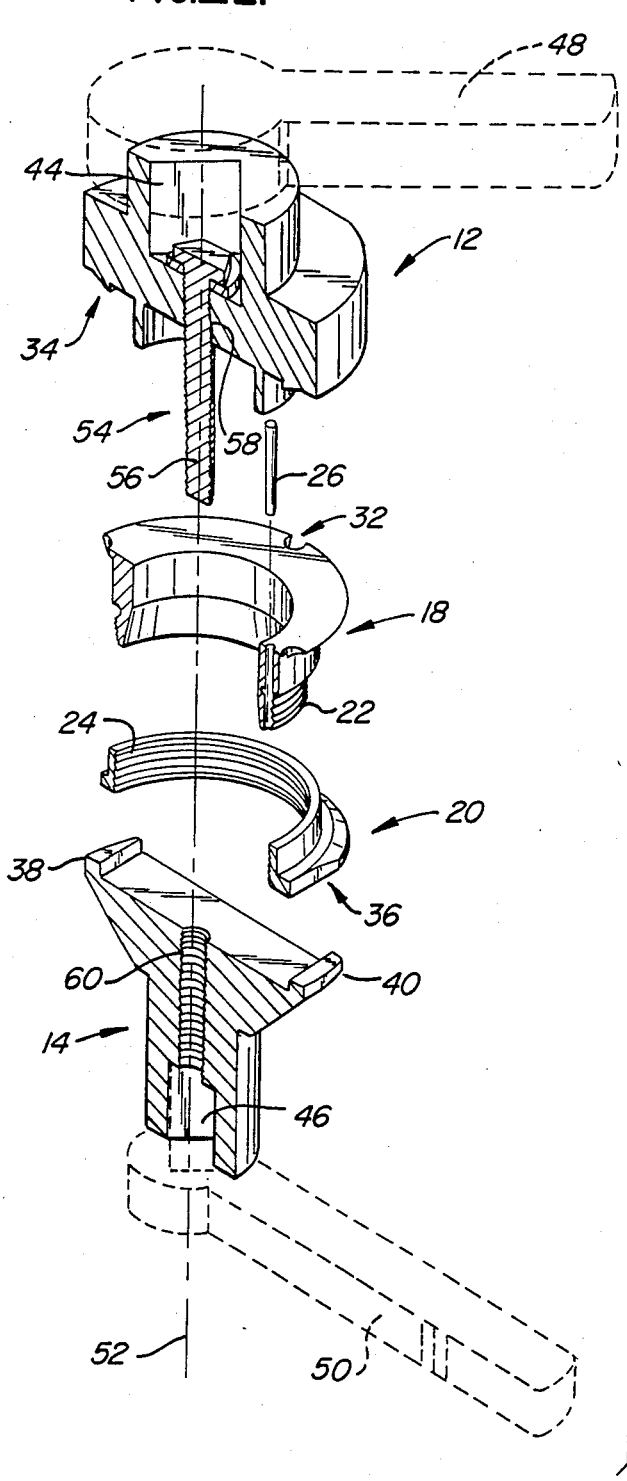
FIG. 3 is an exploded perspective sectional view of the tool in its environment as depicted in FIG. 1.

The invention as a whole is illustrated in the drawings and identified by reference character 10. The tool 10 possesses a first portion 12 and a second portion 14. Tool 10 is employed to separate or assemble a unit 16, FIG. 2, formed by a first member 18 and a second member 20. With reference to FIG. 3 it may be seen that first member 18 includes a threaded portion 22 which threadingly engages an internal threaded portion 24 of second member 20. Unit 16 is formed or assembled by threadingly engaging first member 18 with second member 20 and torquing this engagement to 70–75 foot pounds. Pin 26 is inserted at this point and formed into an enlarged end portion 28 at the bottom surface 30 of second member 20. Tool 10 may be employed to achieve this assembly of unit 16, hereinafter described. It should be noted that the first member 18 includes a multiplicity of recesses 32 which are engaged by a multiplicity of protrusions 34 of first portion 12 of tool 10. This feature aids in the locking of first portion 12 to first member 18. Likewise, second portion 20 includes a pair of flattened parts 36 on the periphery of the same. Ears 38 and 40 of second portion of tool 10 engage flattened parts 36 in this regard to help the locking of second portion 14 to second member 20.

Figure 1:
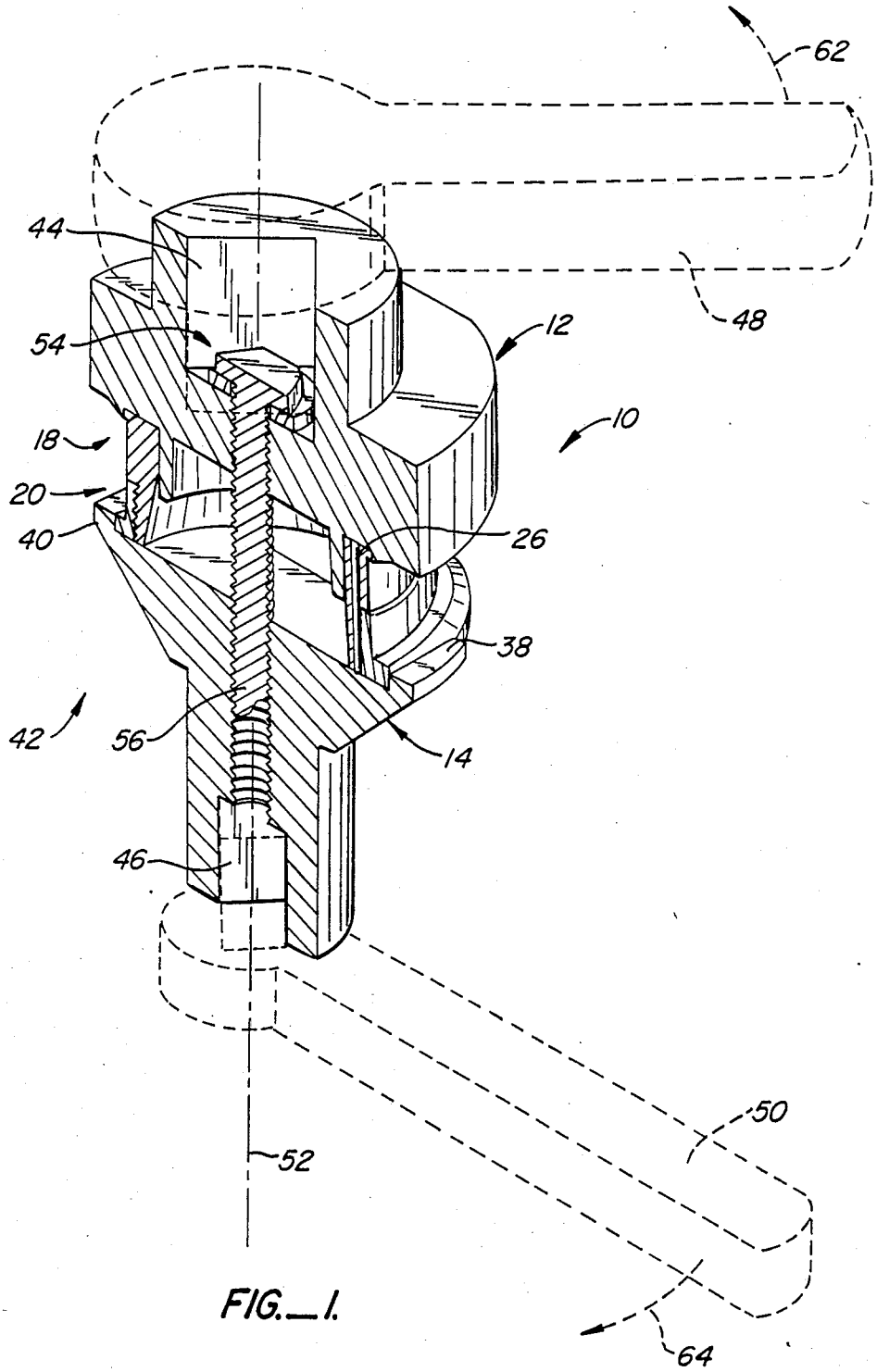
FIG. 1 is a top right perspective view of the tool in its environment depicting torquing arms in phantom.

Means 42 is depicted for rotating first portion 12 relative to second portion 14 during engagement of first and second members 18 and 20 of unit 16. In separating unit 16, such rotation would be of a sufficient degree to break shear pin 26 and permit unthreading of threaded portions 22 and 24, thereof. When assembling unit 16 relative rotation members 18 and 20 would achieve a required torque before the insertion of shear pin 26. Means 42 may include the provision of sockets 44 and 46 in first and second portions 12 and 14. The sockets 44 and 46 permit the use of torquing tools 48 and 50, illustrated as ratchet drives in FIGS. 1 and 3 (phantom).

It should be noted that first and second portions 12 and 14 of tool 10 and first and second members 18 and 20 of unit 16 generally rotate unit 16 relative to axis 52. Means 54 holds the first portion 12 in alignment with second portion 14 relative to axis 52. This alignment is maintained during rotation of first portion 12 and interlocked member 18 relative to second portion 14 and interlocked member 20 during the separation or assembly process. Means 54 may externalize into a threaded bolt 56 which threadingly engages a threaded bore through first portion 12 and a threaded bore 60 through second portion 14. Bores 58 and 60 of first and second portions 12 and 14 respectively, are co-axial with axis 52, heretofore described.

In operation, the user of tool 10 places first portion atop first member 18 of unit 16 and second portion 14 below second member 20 of unit 16. Protrusions 34 of first portion 12 engage recesses 32 of first member 18. Likewise, ears 38 and 40 of second portion 14 fit snugly along flattened part 36 of lower unit 20. Bolt 56 is threaded to bores 58 and 60 to tighten the engagement of first and second portions 12 and 14 with unit 16. Torquing tools 48 and 50 are then placed in sockets 44 and 46, respectively. Directional arrows 62 and 64 show the turning direction required to create relative motion between first and second portions 12 and 14 of tool 10. Sufficient manual force may be applied in this situation by torquing tools 48 and 50 to break shear pin 26 and allow the unthreading of first member 18 from second member 20. To assemble unit 16 first and second portions 12 and 14 are turned opposite to directional arrows 62 and 64 to a required degree of torque. Shear pin 26 is inserted at this point. During the pin shearing or pin insertion steps, heretofore described, bolt 56 maintains the axial alignment of first and second portions 12 and 14 of tool 10 and also prevents uncontrolled movement along axis 52 of these tool portions. It should be noted that once unit 16 is separated with the shearing of pin 26, it is not reused under certain governmental regulations. Likewise, assembly of unit 16 requires the use of members 18 and 20, and shear pin 26 which have not been prior assembled, under the same governmental regulation.

While in the foregoing embodiments of the present invention have been set forth in considerable detail for the purposes of making a complete disclosure of the invention, it may be apparent to those of skill in the art that numerous changes maya be made in such detail without departing from the spirit and principles of the invention.

What is claimed is:

1. A tool for turning a first member rotatable in relation to a second member, to a certain degree of torque, by using a torque arm tool, comprising:

a. a first portion capable of engaging said first member for movement therewith about an axis;

b. a second portion capable of engaging said second member for movement therewith about said axis;

c. means for rotating said first portion relative to said second portion a sufficient degree while engaging said first and second members, respectively, to achieve the certain degree of torque; and d. means for holding said first portion in alignment with said second portion relative to said axis, during said rotation of said first portion relative to said second portion, said holding means including a threaded opening through said first portion, a threaded opening in said second portion, and a threaded member threadingly engaging said threaded openings in said first and second members.

2. The tool of claim 1 in which said threaded openings in said first and second portions are co-axial to said axis of said first and second portions.

3. The tool of claim 1 in which said means for rotating said first portion relative to said second portion includes said first portion providing a socket engageable by the torque arm tool.

4. The tool of claim 3 in which said means for rotating said first portion relative to said second portion includes said second portion providing a socket engageable by the torque arm tool.

5. The tool of claim 4 in which said socket in said first portion encompasses said threaded opening through said first portion.

* * * * *